US006708876B1

(12) United States Patent
Shirah

(10) Patent No.: US 6,708,876 B1
(45) Date of Patent: Mar. 23, 2004

(54) SOLAR POWERED LIGHTED MAILBOX

(76) Inventor: Joseph C. Shirah, 12437 Country Rd. 137, Wellborn, FL (US) 32094

( * ) Notice: Subject to any disclaimer, the term of this patent is extended or adjusted under 35 U.S.C. 154(b) by 0 days.

(21) Appl. No.: 10/180,589

(22) Filed: Jun. 27, 2002

(51) Int. Cl.[7] ..... B65D 91/00
(52) U.S. Cl. ..... 232/38; 40/566
(58) Field of Search ..... 232/38, 17; 40/566; 362/154, 155

(56) References Cited

U.S. PATENT DOCUMENTS 1,657,967 A * 1/1928 Kichline ..... 40/566
1,789,239 A * 1/1931 Landgraf ..... 40/566
1,976,117 A * 10/1934 Cassel ..... 340/569
2,053,588 A * 9/1936 Voepel ..... 40/580
D306,228 S * 2/1990 Hoffman et al. ..... D99/31
5,143,285 A * 9/1992 Wise ..... 232/39
5,460,325 A * 10/1995 Surman ..... 232/17
5,522,540 A * 6/1996 Surman ..... 232/17
5,649,378 A * 7/1997 Roesser et al. ..... 40/559
5,813,749 A * 9/1998 Sheldon ..... 362/155
6,102,548 A * 8/2000 Mantle et al. ..... 362/155
6,299,325 B1 * 10/2001 Cathel ..... 362/183

* cited by examiner

*Primary Examiner*—William L. Miller

(57) ABSTRACT

A solar powered lighted mailbox for identifying more easily the addresses of houses or homes. The solar powered lighted mailbox includes a mail-receiving assembly including a box having walls and an open front end, and also including a door being hingedly attached to the box and being closable over the open front end; and also includes an address display assembly being mounted to the box and including racks being attached to the box; and further includes a light-emitting assembly being mounted to the box for emitting light.

4 Claims, 2 Drawing Sheets

SOLAR POWERED LIGHTED MAILBOX

BACKGROUND OF THE INVENTION

1. Field of the Invention

The present invention relates to lighted mailboxes and more particularly pertains to a new solar powered lighted mailbox for identifying more easily the addresses of houses or homes.

2. Description of the Prior Art

The use of lighted mailboxes is known in the prior art. More specifically, lighted mailboxes heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. Nos. 5,522,540; 5,460,325; 1,659,351; 5,649,378; 6,102,548; and U.S. Pat. No. Des. 313,106.

While these devices fulfill their respective, particular objectives and requirements, the aforementioned patents do not disclose a new solar powered lighted mailbox. The prior art includes solar panels for lighting up mailboxes.

SUMMARY OF THE INVENTION

The general purpose of the present invention, which will be described subsequently in greater detail, is to provide a new solar powered lighted mailbox which has many of the advantages of the lighted mailboxes mentioned heretofore and many novel features that result in a new solar powered lighted mailbox which is not anticipated, rendered obvious, suggested, or even implied by any of the prior art lighted mailboxes, either alone or in any combination thereof. The present invention includes a mail-receiving assembly including a box having walls and an open front end, and also including a door being hingedly attached to the box and being closable over the open front end; and also includes an address display assembly being mounted to the box and including racks being attached to the box; and further includes a light-emitting assembly being mounted to the box for emitting light. None of the prior art includes a rack having an elongate opening through which light is passed, and also includes panel members having openings which are structured as numerals and through which light is passed.

There has thus been outlined, rather broadly, the more important features of the solar powered lighted mailbox in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

It is an object of the present invention to provide a new solar powered lighted mailbox which has many of the advantages of the lighted mailboxes mentioned heretofore and many novel features that result in a new solar powered lighted mailbox which is not anticipated, rendered obvious, suggested, or even implied by any of the prior art lighted mailboxes, either alone or in any combination thereof.

Still another object of the present invention is to provide a new solar powered lighted mailbox for identifying more easily the addresses of houses or homes.

Still yet another object of the present invention is to provide a new solar powered lighted mailbox that is easy and convenient to set up and use.

Even still another object of the present invention is to provide a new solar powered lighted mailbox that is energy efficient and doesn't add cost to the user's utility bill.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
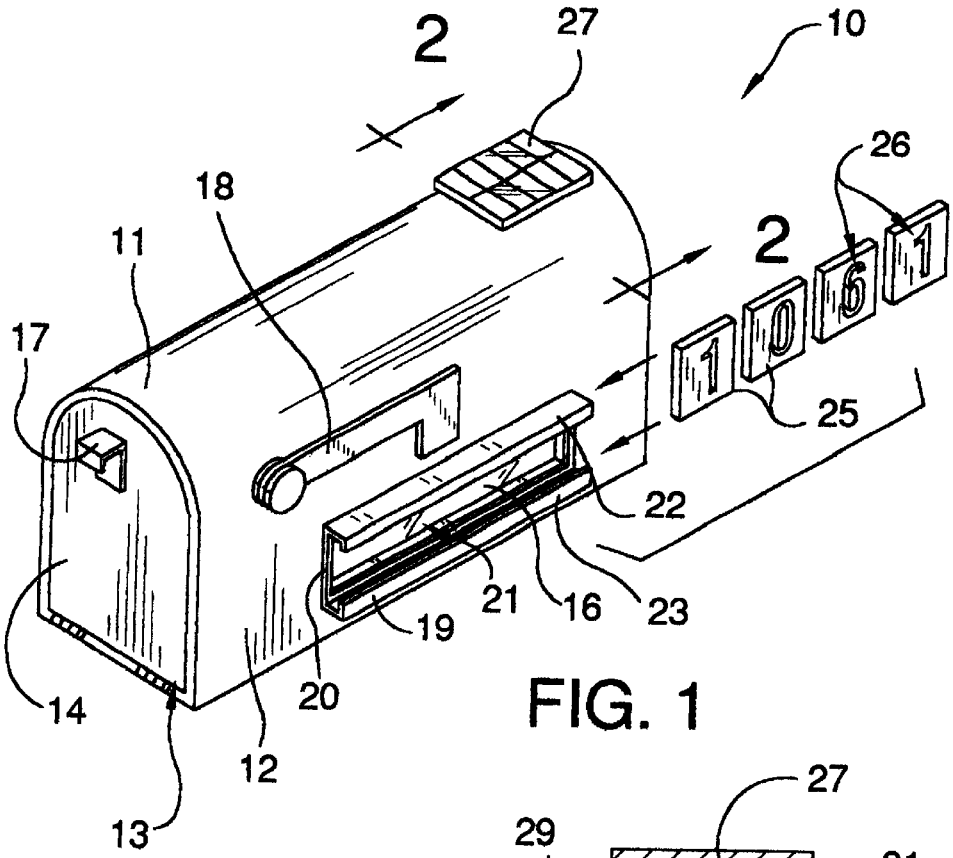
FIG. 1 is a perspective view of a new solar powered lighted mailbox according to the present invention.
Figure 2:
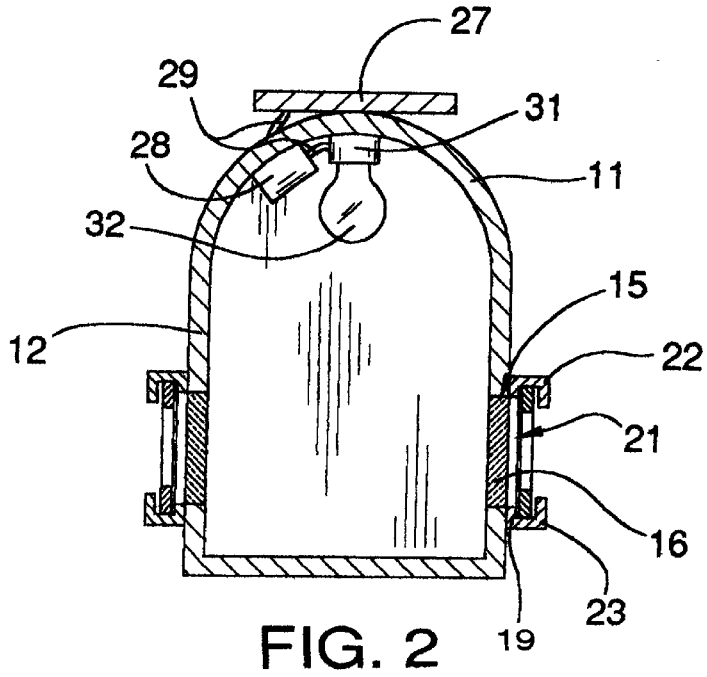
FIG. 2 is a cross-sectional view of the present invention.
Figure 3:
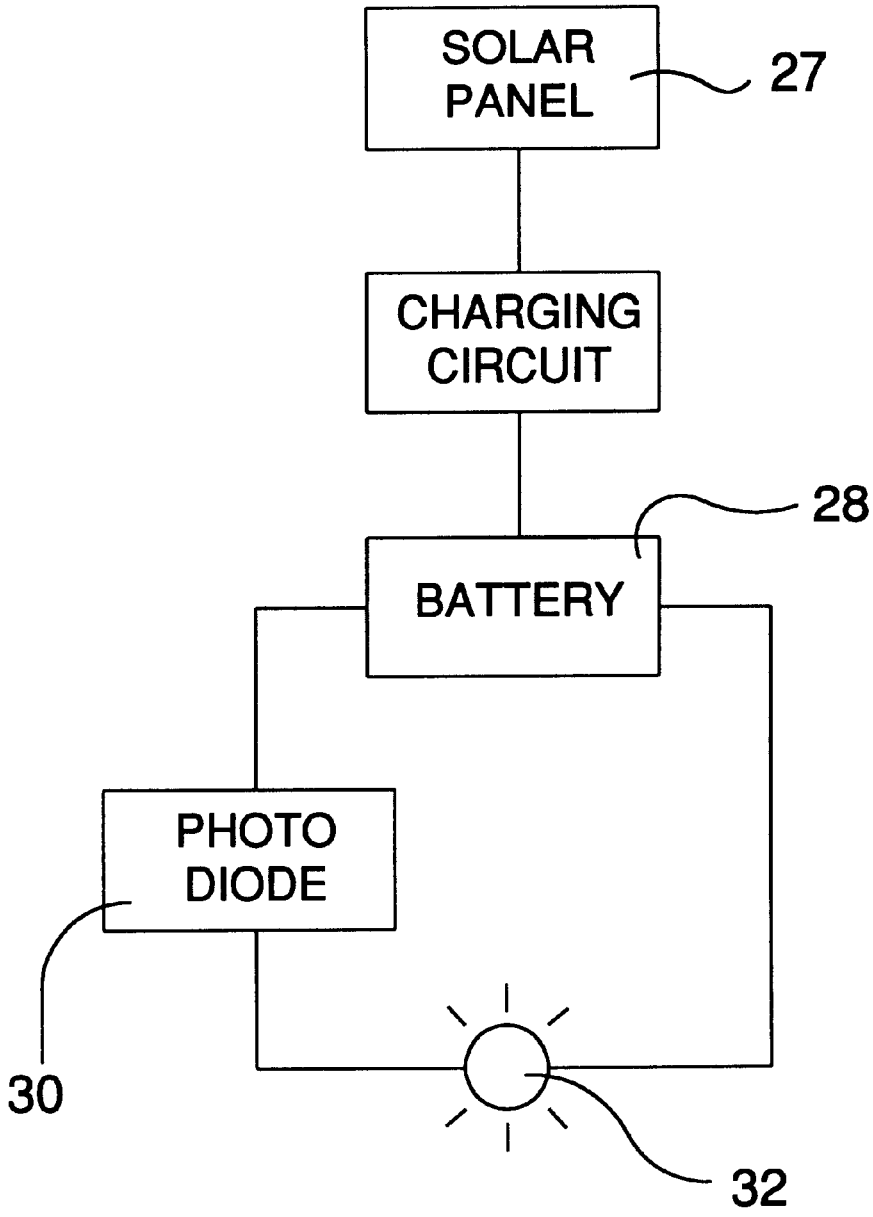
FIG. 3 is a schematic diagram of the present invention.

With reference now to the drawings, and in particular to FIGS. 1 through 3 thereof, a new solar powered lighted mailbox embodying the principles and concepts of the present invention and generally designated by the reference numeral 10 will be described.

As best illustrated in FIGS. 1 through 3, the solar powered lighted mailbox 10 generally comprises a mail-receiving assembly including a box 11 having walls 12 and an open front end 13, and also including a door 14 being hingedly and conventionally attached to the box 11 and being closable over the open front end 13. The box 11 has openings 15 being disposed through the walls 12 thereof. The mail-receiving assembly further includes windows 16 being conventionally disposed in the openings 15. The mail-receiving assembly also includes a handle 17 being conventionally attached to an outer side of the door 14 for opening and closing the door 14, and further includes a flag member 18 being pivotally and conventionally attached to an outer side of one of the walls 12 of the box 11.

An address display assembly is conventionally mounted to the box 11 and includes racks 19 being conventionally attached to the box 11. Each rack 19 is conventionally mounted upon the box and is disposed over a respective one of the windows 16 with each rack 19 having a main planar portion 20 having an elongate opening 21 being disposed therethrough and extending approximately a length thereof, and also having longitudinal end portions 22,23 which are angled relative to the main planar portion 20 and which form tracks. Each rack 19 has a generally C-shaped lateral cross-section. The address display assembly further includes a plurality of panel members 25 being removably disposed upon the tracks. Each of the panel members 25 has an opening 26 being disposed therethrough with the opening 26 of the panel member 25 being structured to form a particular numeral.

A light-emitting assembly is conventionally mounted to the box 11 for emitting light. The light-emitting assembly includes a solar panel 27 being conventionally attached to a top of the box 11 for collecting solar energy from the sun and for converting the solar energy to electrical energy, and also includes a battery 28 being conventionally mounted in the box 11 and being connected with wires 29 to the solar panel 27, and further includes a photo diode 30 being conventionally connected to the battery 28, and also includes a light socket member 31 being conventionally mounted in the box 11 and being conventionally connected to the photo diode 30, and further includes a light-emitting member 32 being removably disposed in the light socket member 31 for emitting light in the box 11 and through the windows 16, the openings 21 through the racks 19, and the openings 26 of the panel members 25. The solar panel 27 also includes battery charging circuitry.

In use, the solar panel 27 would collect the solar energy which is converted to electrical energy and stored in the battery 28, and the battery 28 would energize the light-emitting member 32 which would emit light through the windows and through the openings 26 of the panel members 25 so that the numerals indicating the address would be easily visible for guests and others.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the solar powered lighted mailbox. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A solar, powered lighted mailbox comprising:

a mail-receiving assembly including a box having side, end, and bottom walls and an open front end, and also including a door being hingedly attached to said box and being closable over said open front end, said box having openings in said side walls thereof, said mail-receiving assembly further including windows being disposed in said openings; an address display assembly being mounted to said box and including racks being attached to said box; a light-emitting assembly being mounted to said box for emitting light; and each said rack being mounted upon said box and being disposed over a respective one of said windows; each said rack having a main planar portion having an opening being disposed therethrough and extending approximately a length thereof, and also having longitudinal end portions which are angled relative to said main planar portion and which form tracks; each said rack having a generally C-shaped lateral cross-section.

2. A solar powered lighted mailbox as described in claim 1, wherein said address display assembly further includes a plurality of panel members being removably disposed upon said tracks, each of said panel members having an opening being disposed therethrough, said opening of said panel member being structured to form a particular number.

3. A solar powered lighted mailbox as described in claim 2, wherein said light-emitting assembly includes a solar panel being attached to a top of said box for collecting solar energy from the sun and for converting the solar energy to electrical energy, and also includes a battery being mounted in said box and being connected with wires to said solar panel, and further includes a photo diode being connected to said battery, and also includes a light socket member being mounted in said box and being connected to said photo diode, and further includes a light-emitting member being removably disposed in said light socket member for emitting light in said box and through said windows, said openings through said racks, and said openings of said panel members.

4. A solar powered lighted mailbox as described in claim 3, wherein said solar panel includes battery charging circuitry.

* * * * *